US011877674B2

(12) United States Patent
Engle

(10) Patent No.: US 11,877,674 B2
(45) Date of Patent: Jan. 23, 2024

(54) MODULAR CAKE POP DISPLAY (MCPD) SYSTEM

(71) Applicant: FEF3 Systems LLC, Seattle, WA (US)

(72) Inventor: Steven Engle, Seattle, WA (US)

(73) Assignee: FEF3 Systems LLC, Seattle, WA (US)

( * ) Notice: Subject to any disclaimer, the term of this patent is extended or adjusted under 35 U.S.C. 154(b) by 0 days.

(21) Appl. No.: 17/856,162

(22) Filed: Jul. 1, 2022

(65) Prior Publication Data

US 2023/0007904 A1 Jan. 12, 2023

Related U.S. Application Data

(60) Provisional application No. 63/219,193, filed on Jul. 7, 2021.

(51) Int. Cl.
*A47F 7/00* (2006.01)
*A47G 23/06* (2006.01)

(52) U.S. Cl.
CPC ..... *A47F 7/0028* (2013.01); *A47F 7/0071* (2013.01); *A47G 23/0641* (2013.01)

(58) Field of Classification Search
CPC .... A47F 7/0028; A47F 7/0071; A47F 7/0078; A47F 7/283; A23G 3/563; A47G 23/0641; A47G 23/065; A47G 2400/06; A47G 2400/061
USPC ..... 211/85.18, 60.1, 85.4, 126.3, 126.2, 211/126.7; 108/53.1, 55.3, 57.19; 206/558, 562, 443; D7/610; 403/292
See application file for complete search history.

(56) References Cited

U.S. PATENT DOCUMENTS 986,395 A * 3/1911 King ..... A01G 9/28 47/33
2,006,938 A * 7/1935 Birkenhauer ..... A21B 3/132 D7/357
3,341,053 A * 9/1967 Keene ..... B65D 1/243 206/427
3,431,041 A * 3/1969 Bernat ..... A47F 7/0028 426/115
3,532,221 A * 10/1970 Kaluhiokalani ..... A45D 44/02 206/564
3,696,761 A * 10/1972 Brown ..... B65D 19/38 108/56.1
4,008,543 A * 2/1977 Vilt ..... A01G 9/081 47/1.01 R
4,069,941 A * 1/1978 Popplewell, Jr. ..... A47F 7/147 206/215
4,190,166 A * 2/1980 Allsop ..... A63C 11/22 211/70.5
4,505,395 A * 3/1985 Nathan ..... A47F 7/147 403/292

(Continued)

*Primary Examiner* — Jennifer E. Novosad
(74) *Attorney, Agent, or Firm* — Bracewell LLP; Doug F. Stewart; Patrick J. Connolly

(57) ABSTRACT

A system of interchangeable, interconnectable, standardized components that individually, or as an assembly, display stick-mounted and stick-like food and non-food products in a vertical or substantially fashion. Examples of stick-mounted or stick-like objects include lollypops, corn dogs, chop sticks, pens, pencils, markers, and skewers. Other examples may include stick-like tools, such as knives, wrenches, ratchets, or screwdrivers. Still other examples may include stick-like kitchen implements, such as spoons, spatulas, forks, whisks, etc.

4 Claims, 7 Drawing Sheets

(56) References Cited

U.S. PATENT DOCUMENTS 4,844,243 A * 7/1989 Stiles ..... A47F 3/14 426/119
5,094,348 A * 3/1992 Harris ..... A47B 87/00 211/85.4
5,224,594 A * 7/1993 Hou ..... B43M 99/001 206/214
5,606,921 A * 3/1997 Elder ..... B65D 19/0018 108/901
5,755,325 A * 5/1998 Willhite ..... A47F 7/0028 220/636
D403,558 S * 1/1999 Martinez ..... D7/610
5,996,802 A * 12/1999 Parker ..... A47F 7/0071 229/932
6,258,041 B1 * 7/2001 Pitesky ..... A61B 5/441 600/556
6,561,363 B1 * 5/2003 Willhite ..... A47F 7/0071 206/443
7,044,066 B1 * 5/2006 Miller ..... B65D 19/44 108/55.3
7,441,731 B2 * 10/2008 Smart ..... F16L 3/02 248/68.1
7,669,721 B2 * 3/2010 Kemper ..... A47L 19/04 211/41.3
8,069,609 B1 * 12/2011 Towne ..... A47G 7/06 47/41.12
8,132,771 B2 * 3/2012 Lee ..... B61D 45/00 211/49.1
8,210,355 B2 * 7/2012 Lee ..... C23C 14/50 206/562
8,276,315 B2 * 10/2012 Meisinger ..... A23G 3/28 47/41.01
8,336,721 B2 * 12/2012 Traldi ..... A47B 87/0269 211/205
8,573,428 B2 * 11/2013 Furuta ..... B65D 21/0212 220/23.8
8,683,769 B2 * 4/2014 Cerny ..... E04F 15/02194 52/584.1
D723,759 S * 3/2015 Evans ..... D32/55
9,839,304 B2 * 12/2017 Liao ..... A47F 5/04
11,344,139 B2 * 5/2022 McCloskey ..... F16B 5/0036
11,369,216 B2 * 6/2022 Fleega ..... A47F 5/0823
11,427,379 B2 * 8/2022 Fitzgerald ..... B65D 19/004
11,564,514 B2 * 1/2023 Matsuno ..... A47F 7/0071
2002/0177092 A1 * 11/2002 Latzel ..... F21V 35/00 431/295
2003/0226782 A1 * 12/2003 Loughlin ..... A47F 7/0078 426/104
2006/0113303 A1 * 6/2006 Huruta ..... B65D 21/0204 220/23.4
2008/0283526 A1 * 11/2008 Buchanan ..... B65D 21/0204 220/23.4
2012/0298014 A1 * 11/2012 Wilson ..... B65D 19/0016 29/428
2014/0284436 A1 * 9/2014 Erwin ..... A47F 7/0028 248/176.1
2016/0128477 A1 * 5/2016 Jensen ..... A47F 7/283 211/85.18
2020/0253398 A1 * 8/2020 Matsuno ..... A47G 19/02
2023/0007904 A1 * 1/2023 Engle ..... A47F 7/0028

* cited by examiner

MODULAR CAKE POP DISPLAY (MCPD) SYSTEM

CROSS REFERENCE TO RELATED APPLICATIONS

Pursuant to 35 U.S.C. § 119(e), this application claims priority from, and the benefit of, U.S. provisional patent application No. 63/219,193 filed on Jul. 7, 2021, the entire contents of which is hereby incorporated by reference for all purposes as if fully set forth herein.

FIELD OF INVENTION

This invention relates to a system, apparatus, and method for displaying and presenting stick-mounted or stick-like objects, including edible and inedible products (e.g., cake pops, corn dogs, chop sticks, fans, skewers, etc.).

BACKGROUND OF THE INVENTION

Due to uneven weight-distribution and awkward spatial geometry, the effective and attractive display of stick-mounted or stick-like objects can be challenging at best. It can be difficult to present large selections of stick-mounted or stick-like objects to consumers or potential customers quickly and effectively in a way that is well-supported, unobtrusive, attractive, and easily configurable.

There exists a need for a system, apparatus, and method for displaying stick-mounted objects in a uniform and attractive manner that is modular, flexible, quickly constructed, and adaptable to the needs of a purveyor of stick-mounted or stick-like objects. Furthermore, there exists a need for a modular system that is quickly re-usable and rearrangeable, with minimal use of tools.

SUMMARY OF THE INVENTION

The present invention is a system of interchangeable, interconnectable, standardized components that individually, or as an assembly, display stick-mounted and stick-like food and non-food products in a vertical or near-vertical fashion. Examples of stick-mounted or stick-like objects include lollypops, corn dogs, chop sticks, pens, pencils, markers, and skewers. Other examples may include stick-like tools, such as knives, wrenches, ratchets, or screwdrivers. Still other examples may include stick-like kitchen implements, such as spoons, spatulas, forks, whisks, etc.

BRIEF DESCRIPTION OF THE DRAWINGS

The accompanying drawings are fully incorporated in, and form part of, this specification, and illustrate embodiments of the invention that, together with the description, explain principles of the invention.

DETAILED DESCRIPTION

Reference will now be made in detail to embodiments of the invention, examples of which are illustrated in the accompanying drawings. While the invention is described in conjunction with these embodiments, it will be understood that the descriptions herein are not intended to limit the invention to these embodiments. On the contrary, the invention is intended to cover alternatives, modifications, and equivalents that may be included within the spirit and scope of the invention as defined by the appended claims. Detailed description of components that are well known in the art may be omitted if that detailed description would confuse or obscure the description of the embodiments of the present invention.

Figure 1:
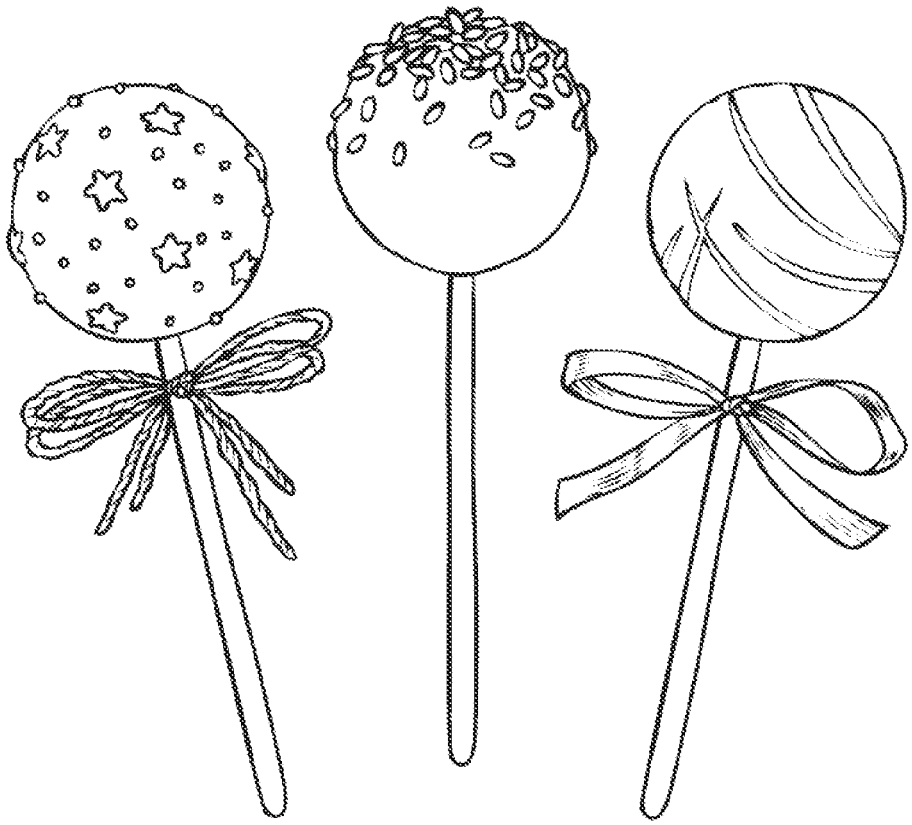
FIG. 1 depicts an example of stick-mounted cake pops.

FIG. 1 depicts several cake pops, an example of a stick-mounted food object that the modular stick object display ("MSOD") system of the present invention is intended to display. As discussed above, the MSOD system is not limited to displaying or presenting cake pops but can also be configured to display all varieties of stick-mounted and stick-like objects, both edible and inedible.

Figure 2:
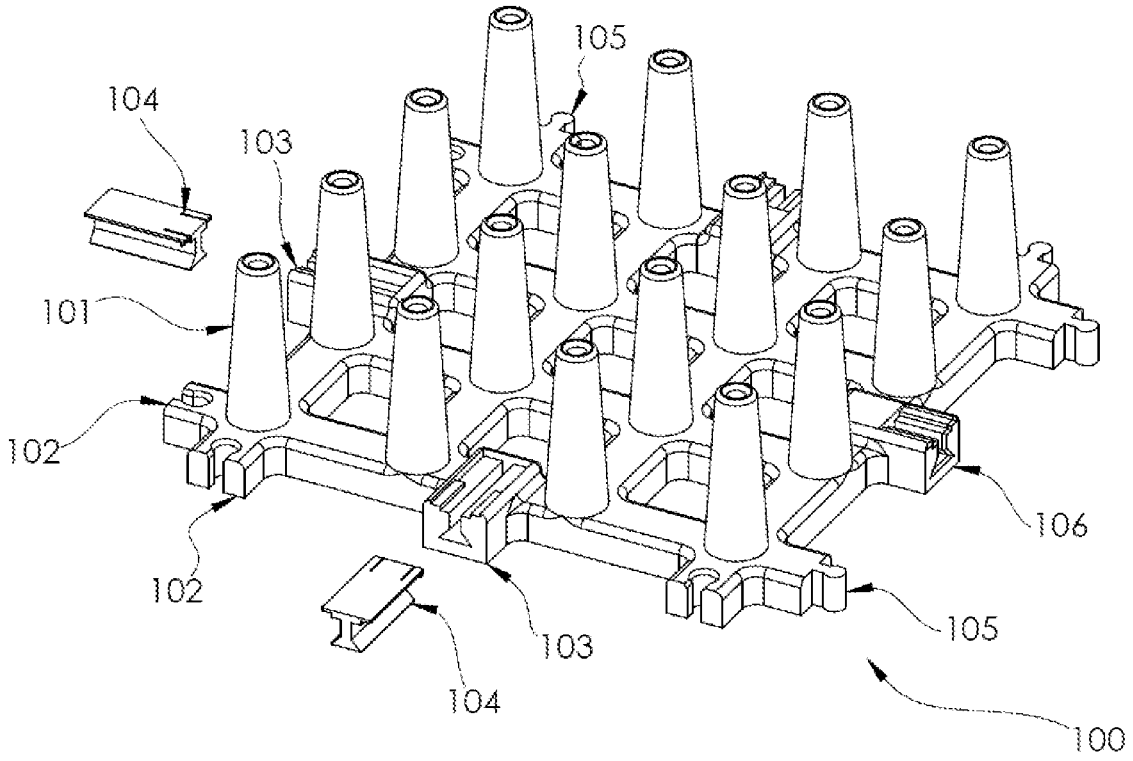
FIG. 2 depicts an exemplary embodiment of a grid component according to the present invention.

FIG. 2 depicts an example square grid component 100 of the MSOD system, which is standardized to allow configuration and interfacing with other MSOD grid components. This allows a purveyor to quickly and easily assemble any number of MSOD grid components to create an effective display of stick-mounted or stick-like objects. Exemplary MSOD grid component 100 may include mast 101, as well as MSOD locking components that include: female interjoin 102, male lock socket 103, lock bar 104, male interjoin 105, and female lock socket 106. Female interjoin 102, male lock socket 103, lock bar 104, male interjoin 105, and lock socket 106 work together to join and lock together multiple MSOD grid components, as will be described below with respect to FIGS. 3 and 5.

Mast 101 is preferably hollow and is configured to support the stick-shaped end of the stick-mounted or stick-like object. The stick-shaped end is inserted into a hole at the top of mast 101. In the case of stick-mounted food objects, the opening of mast 101 is sized to accept commonly available stick sizes. In the case of other stick-like objects, the opening of mast 101 would be sized appropriately. In some example embodiments, mast 101 may be made of a resilient material, such as rubber, to allow expansion and contraction around the stick-shaped end of the inserted stick-mounted or stick-like object. In some exemplary embodiments, the hole size of the masts may be varied in diameter and shape to accommodate stick-shaped ends of different sizes. In any case, by placing the stick shaped end of the object to be displayed in the mast, the object is displayed in a vertical, or near-vertical orientation. Example materials for the various MSOD grid components may include a combination of nylon, polyethylene, silicone, polypropylene, metals, thermoplastic polymers (e.g., ABS, PEEK). It would be understood to one of ordinary skill in the art to choose appropriate materials for the MSOD grid components based on the intended utility of the MSOD grid components. For example, the masts may be formed from a material that is more flexible than the locking components, which may be require a more rigid material.

Figure 3:
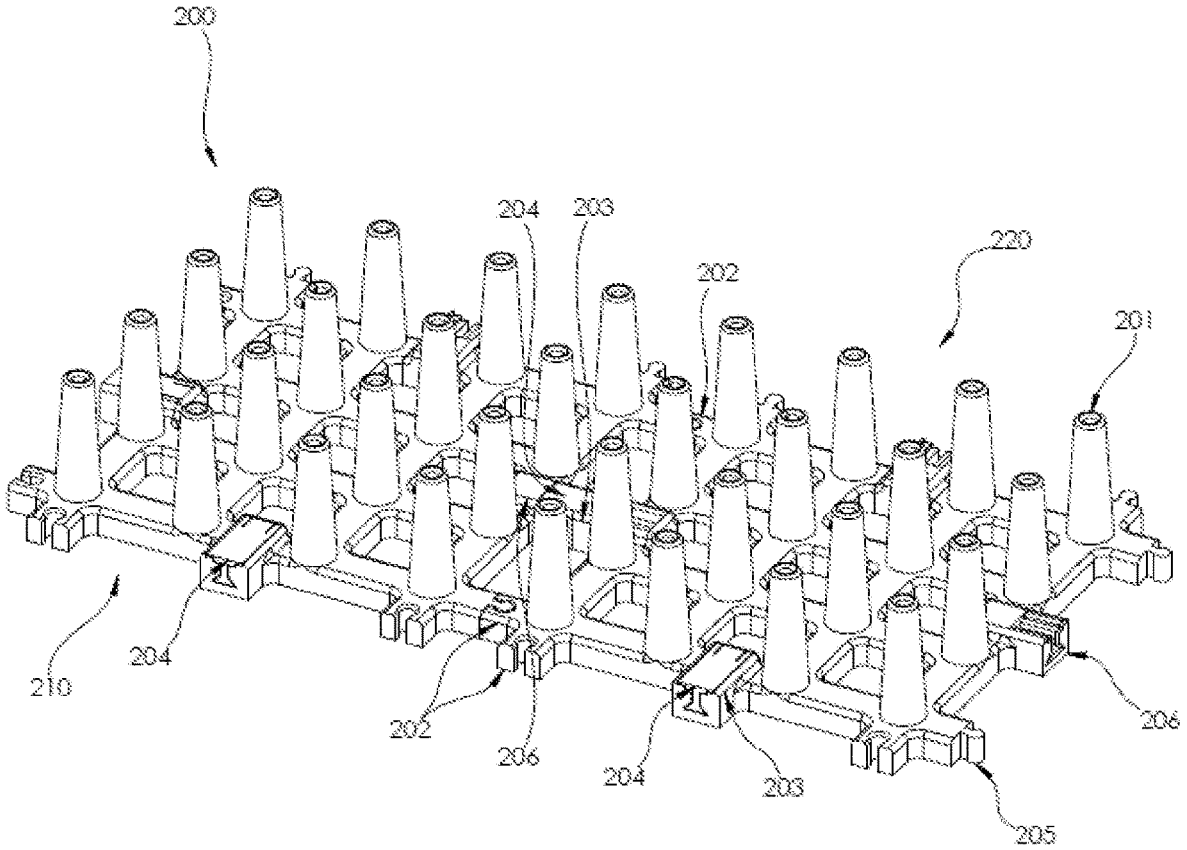
FIG. 3 depicts an exemplary assembly of grid components according to the present invention.

FIG. 3 depicts an example assembly 200 of two MSOD grid components 210 and 220. In this arrangement, exemplary female interjoin 202 mates with male interjoin 205 to connect MSOD grid component 210 to MSOD grid component 220 and lock in a horizontal plane. Furthermore, male lock socket 203 extends lock bar 204 into female lock socket 206 to further connect and secure the MSOD grid components from movement in a vertical direction. Any unused lock sockets are configured to have their lock bars retracted. As such, an extended array of masts, including example mast 201, are arranged to allow for display of stick-mounted or stick-like objects.

Figure 4:
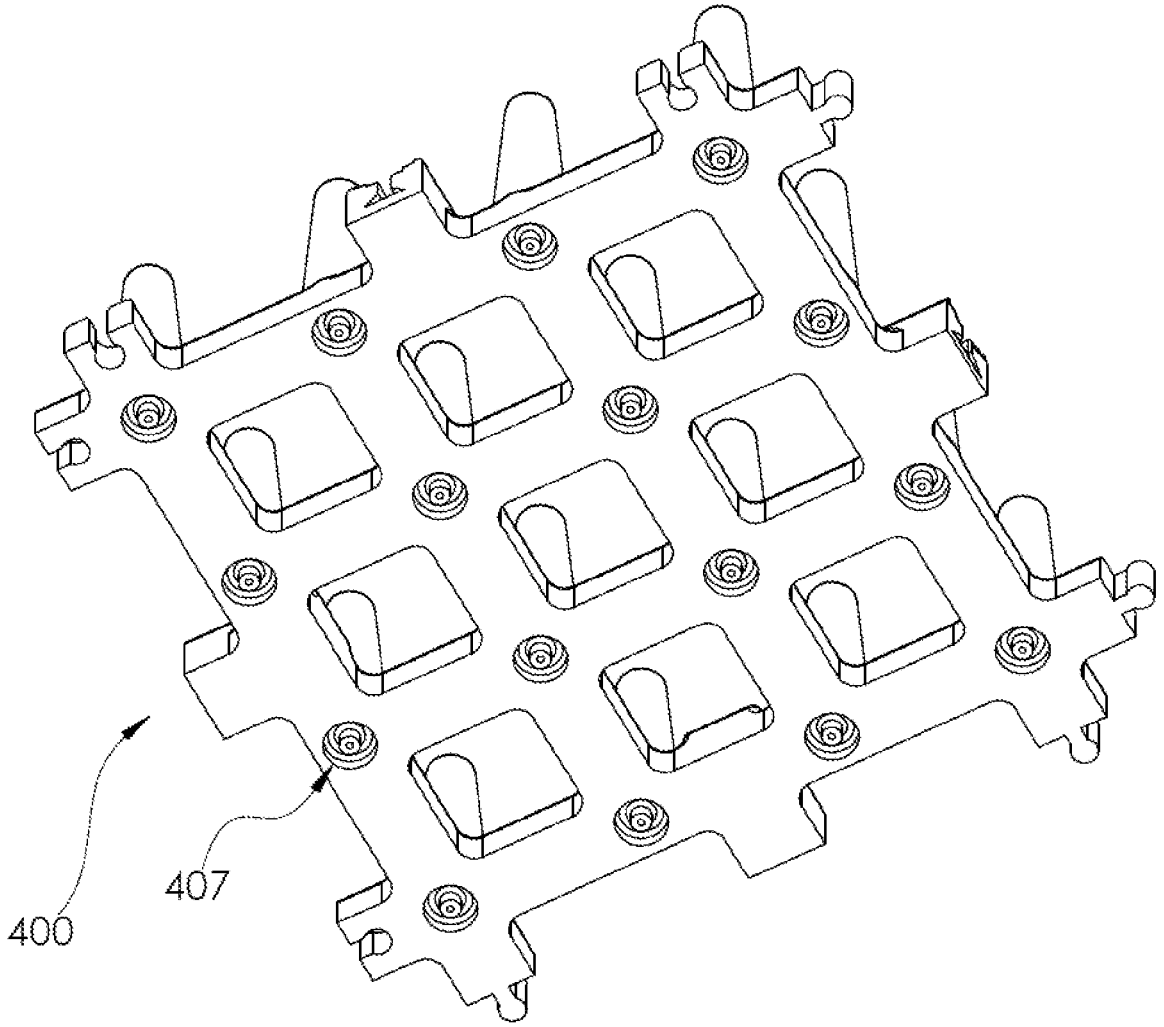
FIG. 4 depicts an exemplary underside of a grid component according to the present invention.

FIG. 4 depicts an underside of an MSOD grid component 400 that includes an array of mast receptacles, including exemplary mast receptacle 407. As will be described with respect to other embodiments of the present invention, these mast receptacles are configured to receive masts, such that a stacked MSOD assembly is created, for example, as depicted in FIG. 5.

Figure 5:
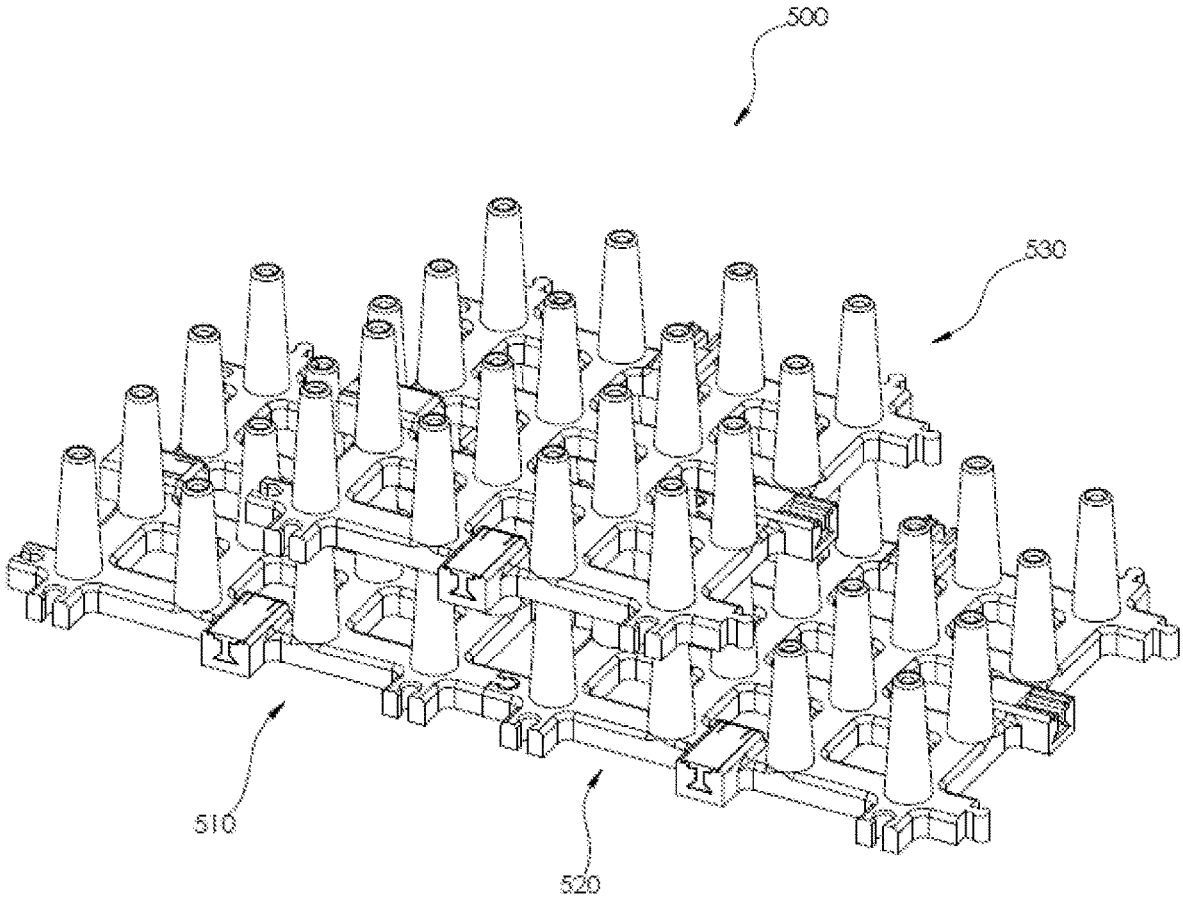
FIG. 5 depicts a second exemplary assembly of grid components according to the present invention.
Figure 6A:
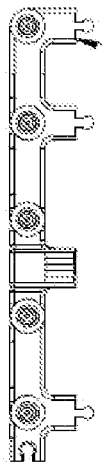
FIGS. 6A-H depict examples of alternative grid components.
Figure 6B:
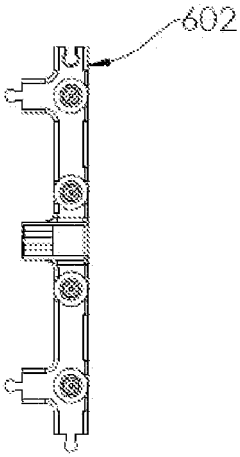
Figure 6C:
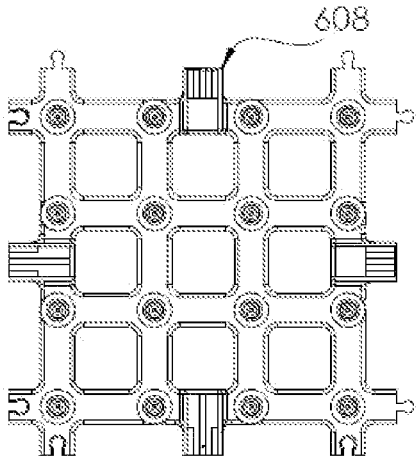
Figure 6D:
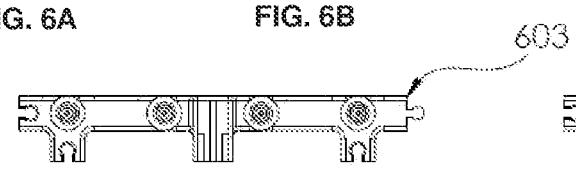
Figure 6E:
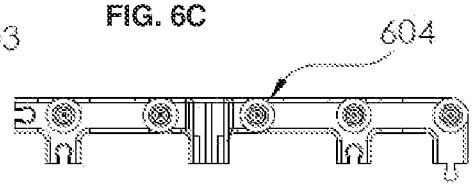
Figure 6G:
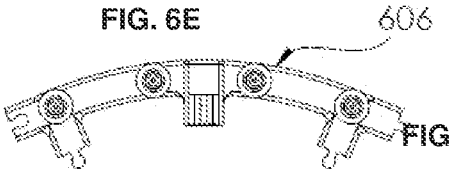
Figure 6F:
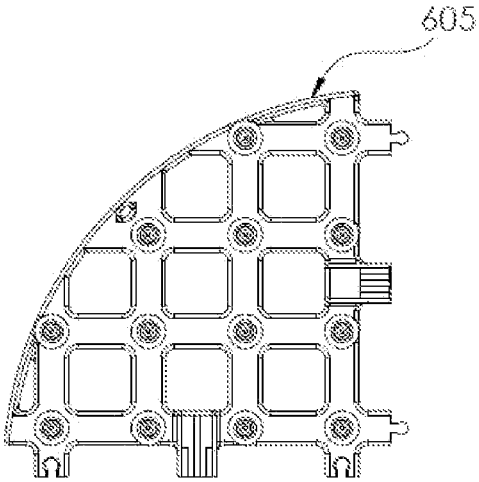
Figure 6H:
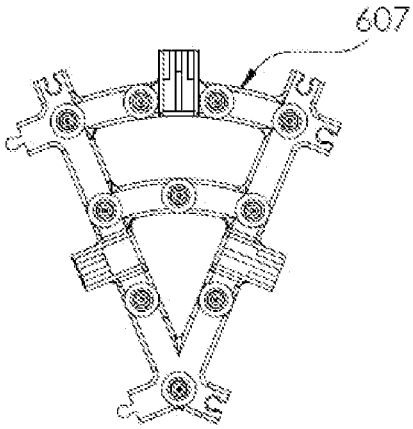

FIG. 5 depicts an exemplary assembly 500 of two MSOD grid components 510 and 520 in combination with a third MSOD grid component 530 stacked on top. As described above with respect to FIG. 4, certain masts of MSOD grid components 510 and 520 are connected to the underside array of mast receptacles on MSOD grid component 530. As such, example assembly 500 creates two tiers of masts for displaying stick-mounted or stick-like objects. Although two tiers are depicted in FIG. 5, it is understood that more MSOD grid components could be stacked to create more tiers of masts for stick-mounted and stick-like object displays.

FIGS. 6A-6H illustrates alternative MSOD grid components that are compatible with the MSOD grid components depicted and described with respect to FIGS. 2-5. These alternative MSOD grid components include female corner edge component 601, female edge component 602, male edge component 603, male corner edge component 604, quarter circle component 605, round edge component 606, and pie component 607. These alternative MSOD grid components interface and lock with the same MSOD locking components, such as square grid component 608, described above with respect to FIGS. 2 and 3.

Figure 7:
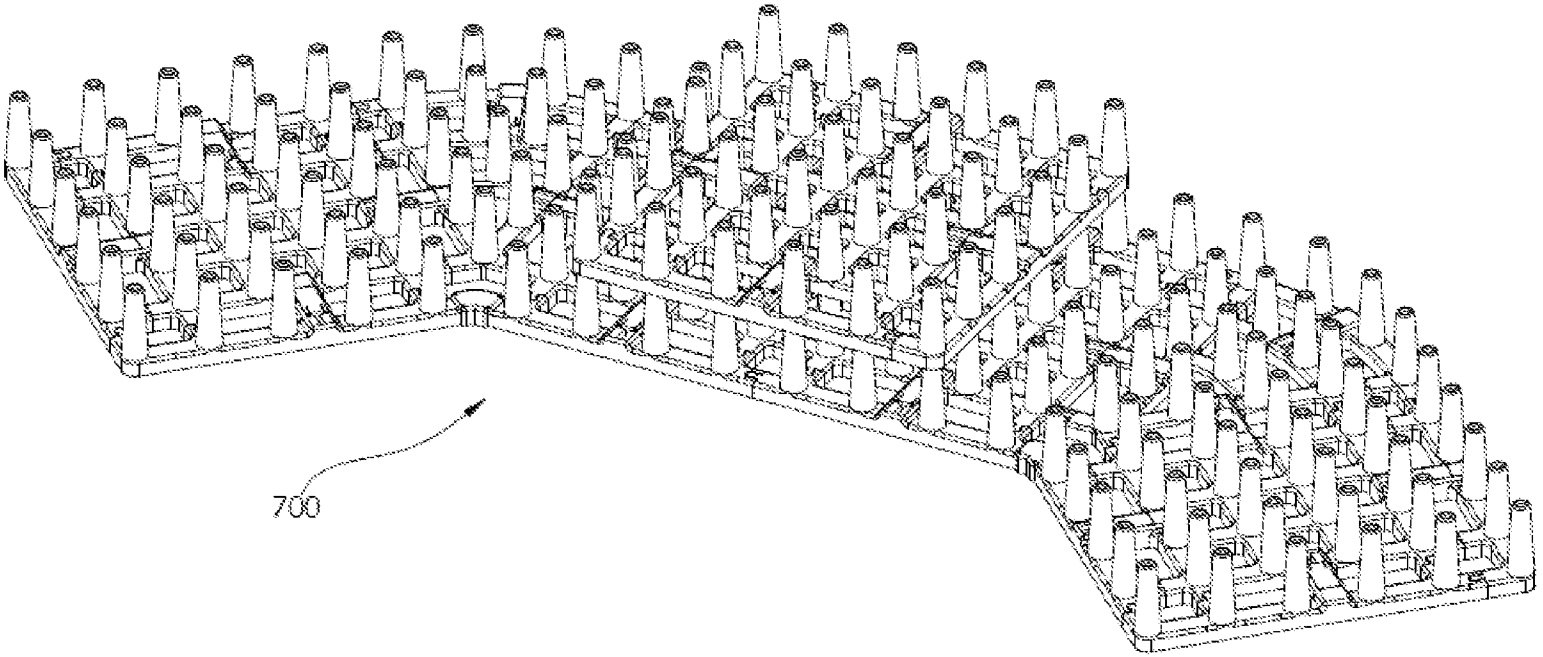
FIG. 7 depicts a third example of a tiered assembly of grid components.

FIG. 7 illustrates an exemplary assembly 700 of multiple MSOD grid components, as depicted and described with respect to FIGS. 2-6, in a curved, tiered arrangement. As described above with respect to FIG. 4, certain masts of the bottom layer of MSOD grid components are connected to the underside array of mast receptacles of the upper layer of the depicted MSOD grid component. As such, exemplary assembly 700 creates two tiers of masts for displaying stick-mounted or stick-like objects with a curbed base. Although two tiers are depicted in FIG. 7, it is understood that more MSOD grid components could be stacked to create further tiers of masts for stick-mounted and stick-like object displays.

Although several exemplary embodiments of the invention have been described, it should be understood that numerous other modifications and embodiments of the invention can be devised by those skilled in the art that will fall within the scope of the principles of this disclosure. More particularly, a range of variations and modifications are possible in the component parts and/or arrangements of the inventive subject matter within the scope of the disclosure, the drawings, and the appended claims. In addition to variations and modifications in the component parts and/or arrangements, alternative uses and applications of the invention will also be apparent to those skilled in the art.

What is claimed:

1. A system configured to display stick-mounted or stick-like objects uniformly in a vertical or substantially vertical orientation, said system comprising:

at least two interlocking grid modules, wherein the at least two interlocking grid modules are configured to interlock with each other wherein each interlocking grid module comprises:

a plurality of lock bars;

a plurality of mast pieces for accepting and supporting the stick-mounted or stick-like objects in the vertical or substantially vertical orientation;

a plurality of male interjoins;

a plurality of female interjoins;

a plurality of male lock of sockets, each of which retains one of the plurality lock bars; and a plurality of female lock sockets, wherein each lock bar, when retained by a male lock socket from the plurality of male lock sockets, extends from the male lock socket of a first of the at least two interlocking grid modules into a female lock socket from the plurality of female lock sockets of a second of the at least two interlocking grid modules, thereby interlocking the first and second interlocking grid modules in a side-by-side configuration, and wherein the underside of each of the at least two interlocking grid modules comprises a plurality of mast receptacles, and the plurality of mast receptacles are configured to interlock with the top portions of the plurality of mast pieces of at least one additional interlocking grid so that at least two interlocking grid modules are connected in a stacked configuration by connecting the plurality of mast receptacles with the top portions of the plurality of mast pieces of the at least one additional grid module.

2. The system of claim 1, wherein each lock bar prevents movement orthogonal to a longitudinal axis of the lock bar extended between the at least two interlocking grid modules.

3. The system of claim 1, wherein the plurality of mast pieces are configured to deform in order to accept the stick-mounted or stick-like objects.

4. The system of claim 3, wherein the plurality of mast pieces are formed from a different material than other components of the grid modules.

* * * * *